US012662898B2

(12) United States Patent
Steele et al.

(10) Patent No.: US 12,662,898 B2
(45) Date of Patent: Jun. 23, 2026

(54) LATERAL LINER INCLUDING A VALVED WIPER PLUG ASSEMBLY

(71) Applicant: Halliburton Energy Services, Inc., Houston, TX (US)

(72) Inventors: David Joe Steele, Carrollton, TX (US); Micah Janzen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/954,437

(22) Filed: Sep. 28, 2022

(65) Prior Publication Data

US 2023/0104289 A1 Apr. 6, 2023

Related U.S. Application Data

(60) Provisional application No. 63/251,479, filed on Oct. 1, 2021.

(51) Int. Cl.
*E21B 33/16* (2006.01)
*E21B 33/12* (2006.01)
*E21B 34/14* (2006.01)

(52) U.S. Cl.
CPC ..... *E21B 33/16* (2013.01); *E21B 33/1208* (2013.01); *E21B 34/142* (2020.05)

(58) Field of Classification Search
CPC ..... E21B 33/1208
See application file for complete search history.

(56) References Cited

U.S. PATENT DOCUMENTS

| | | | | |
|---|---|---|---|---|
| 3,350,130 | A * | 10/1967 | Ahlstone | E21B 17/1007 294/93 |
| 3,796,260 | A * | 3/1974 | Bradley | E21B 33/126 166/153 |
| 4,164,980 | A * | 8/1979 | Duke | E21B 33/076 166/70 |
| 4,457,379 | A | 7/1984 | McStravick | |
| 5,413,172 | A * | 5/1995 | Laurel | E21B 33/16 166/153 |
| 5,803,173 | A * | 9/1998 | Fraser, III | E21B 33/16 166/291 |
| 6,942,039 | B2 * | 9/2005 | Tinker | E21B 33/1294 166/387 |
| 7,350,590 | B2 | 4/2008 | Hosie et al. | |
| 9,217,311 | B2 | 12/2015 | Slup | |
| 9,347,272 | B2 | 5/2016 | Hewson et al. | |
| 9,534,460 | B2 | 1/2017 | Watson et al. | |
| 2003/0164237 | A1 | 9/2003 | Butterfield, Jr. | |
| 2007/0089910 | A1 | 4/2007 | Hewson et al. | |

(Continued)

FOREIGN PATENT DOCUMENTS

WO 2012125660 A2 9/2012

*Primary Examiner* — Theodore N Yao
(74) *Attorney, Agent, or Firm* — Scott Richardson; Parker Justiss, P.C.

(57) ABSTRACT

Provided is a valved wiper plug assembly, a well system, and a method for cementing a lateral liner assembly. The valved wiper plug assembly may include a valved housing, a valve member coupled to the valved housing, the valve member configured to move between an open state to allow cementing and a closed state to catch debris falling from uphole of the valved housing, and a wiper plug assembly coupled to the valved housing proximate a downhole end of the valved housing.

30 Claims, 16 Drawing Sheets

(56) References Cited

U.S. PATENT DOCUMENTS

| | | | | |
|---|---|---|---|---|
| 2011/0061876 | A1* | 3/2011 | Johnson | E21B 33/14 175/57 |
| 2011/0203794 | A1* | 8/2011 | Moffitt | E21B 43/10 166/373 |
| 2016/0177668 | A1 | 6/2016 | Watson et al. | |
| 2018/0023362 | A1* | 1/2018 | Makowiecki | E21B 33/08 166/374 |
| 2018/0080304 | A1 | 3/2018 | Cortez et al. | |

* cited by examiner

LATERAL LINER INCLUDING A VALVED WIPER PLUG ASSEMBLY

CROSS-REFERENCE TO RELATED APPLICATION

This application claims the benefit of U.S. Provisional Application Ser. No. 63/251,479, filed on Oct. 1, 2021, entitled "LATERAL LINER VALVE," commonly assigned with this application and incorporated herein by reference in its entirety.

BACKGROUND

In cementing casing or liners (both referred to hereinafter as "casing") in wellbores (a process known as primary cementing), a cement slurry is pumped downwardly through the casing to be cemented and then upwardly into the annulus between the casing and the walls of the wellbore. Upon setting, the cement bonds the casing to the walls of the wellbore and restricts fluid movement between formations or zones penetrated by the wellbore. Such a cementing operation is particularly useful and/or necessary in the lateral wellbores of multilateral wells, and particularly at the junction between the lateral wellbores and the main wellbore.

Prior to a primary cementing operation, the casing is suspended in a wellbore (e.g., main wellbore or lateral wellbore and both the casing and the wellbore are usually filled with drilling fluid. In order to reduce contamination of the cement slurry at the interface between it and the drilling fluid, a displacement plug for sealingly engaging the inner surfaces of the casing may be pumped ahead of the cement slurry whereby the cement slurry is separated from the drilling fluid as the cement slurry and drilling fluid ahead of it are displaced through the casing. The displacement plug wipes the drilling fluid from the walls of the casing and maintains a separation between the cement slurry and drilling fluid until the plug lands on a float collar attached near the bottom end of the casing.

The displacement plug, which precedes the cement slurry and separates it from drilling fluid is referred to herein as the "bottom plug." When the predetermined required quantity of the cement slurry has been pumped into the casing, a second displacement plug, referred to herein as the "top plug", may be released into the casing to separate the cement slurry from additional drilling fluid or other displacement fluid used to displace the cement slurry. In certain situations, the bottom plug is not used, but the top plug is.

When the bottom plug lands on the float collar attached to the casing, a valve mechanism opens which allows the cement slurry to proceed through the plug and the float collar upwardly into the annular space between the casing and the wellbore. The design of the top plug is such that when it lands on the bottom plug it shuts off fluid flow through the cementing plugs which prevents the displacement fluid from entering the annulus. After the top plug lands on the bottom plug, the pumping of the displacement fluid into the casing is often continued whereby the casing is pressured up and the casing and associated equipment including the pump are pressure tested for leaks or other defects.

BRIEF DESCRIPTION

Reference is now made to the following descriptions taken in conjunction with the accompanying drawings, in which:

FIG. 4A illustrates a cross-sectional view of one embodiment of a valved wiper plug assembly designed, manufactured and operated according to one or more embodiments of the disclosure, whereas

Figure 1:
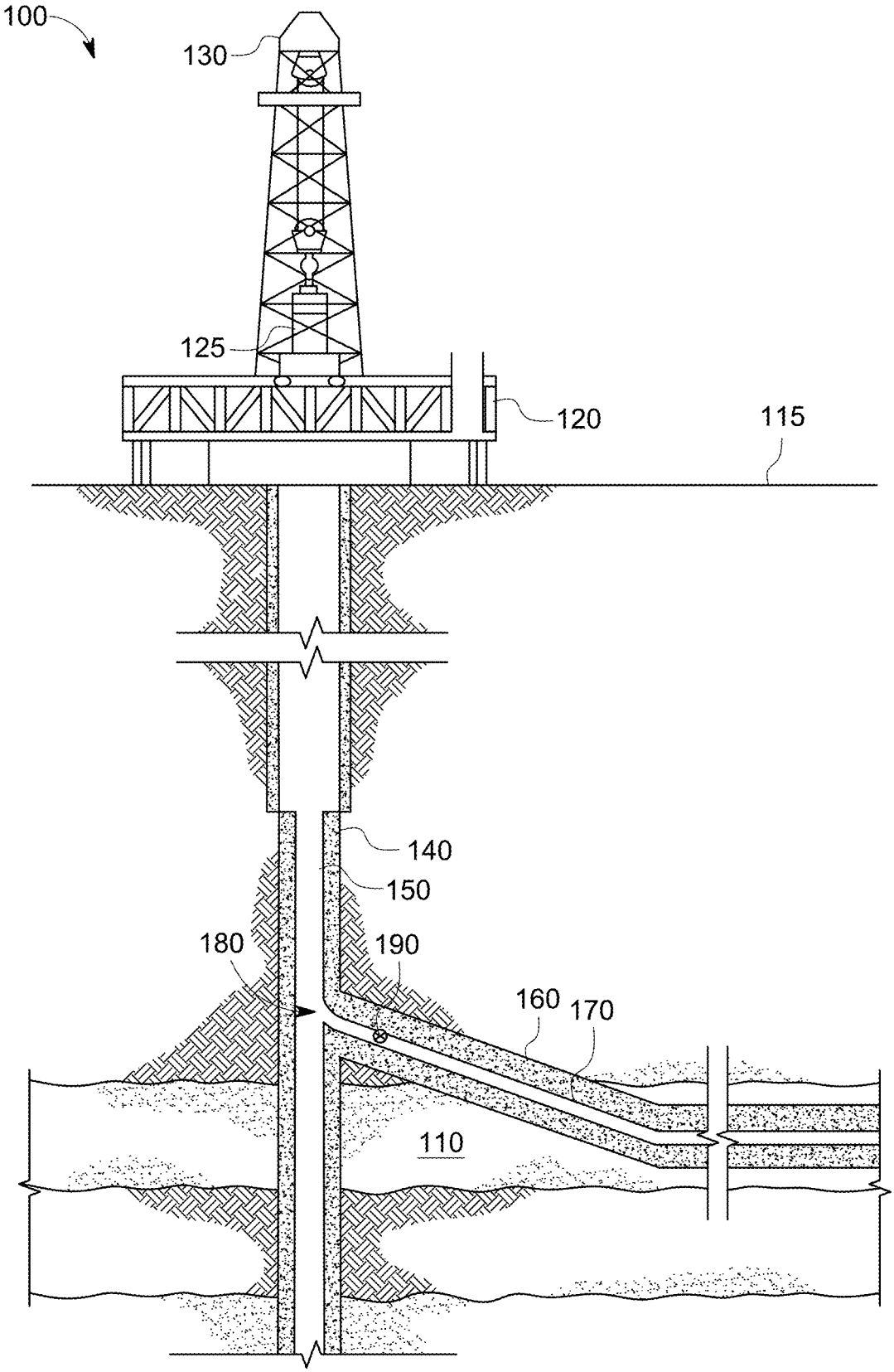
FIG. 1 illustrates a well system including an exemplary operating environment that the apparatuses, systems and methods disclosed herein may be employed.

FIGS. 5A through 5I illustrate sectional views of one embodiment for completing and/or assembling a lateral liner assembly, valved wiper plug assembly, and lateral liner running tool according to one or more embodiments of the disclosure; and FIGS. 6A through 6F illustrate sectional views of an embodiment of a method for cementing a lateral liner assembly, for example employing a valved wiper plug assembly, and lateral liner running tool according to one or more aspects of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure has recognized that in certain circumstances after pumping cement into a lateral liner, cement and/or debris (e.g., hardened cement) existing above the lateral liner running tool tends to fall back into the lateral liner when the lateral liner running tool is pulled out of the transition joint. Based at least in part upon this recognition, the present disclosure has developed a valved wiper plug assembly (e.g., an upside-down check valve) so cement and/or debris cannot fall back into the lateral liner. Accordingly, in at least one embodiment, the valved wiper plug assembly is located somewhere in the lateral liner. In one embodiment, the valved wiper plug assembly is located proximate an upper end of the lateral liner, such that any cement that would fall therein has little volume to fill. Such a situation might save one or more clean-up trips.

FIG. 1 is a schematic view of a well system 100 designed, manufactured and operated according to one or more embodiments disclosed herein. The well system 100 may include a platform 120 positioned over a subterranean formation 110 located below the earth's surface 115. The platform 120, in at least one embodiment, has a hoisting apparatus 125 and a derrick 130 for raising and lowering one or more downhole tools including pipe strings. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 140 has been drilled through the various earth strata, including the subterranean formation 110. The term "main" wellbore is used herein to designate a wellbore from which another wellbore is drilled. It is to be noted, however, that a main wellbore 140 does not necessarily extend directly to the earth's surface, but could instead be a branch of yet another wellbore. A casing string 150 may be at least partially cemented within the main wellbore 140. The term "casing" is used herein to designate a tubular string used to line a wellbore. Casing may actually be of the type known to those skilled in the art as a "liner" and may be made of any material, such as steel or composite material and may be segmented or continuous, such as coiled tubing.

In the illustrated embodiment, a lateral wellbore 160 extends from the main wellbore 140. The term "lateral" wellbore is used herein to designate a wellbore that is drilled outwardly from its intersection with another wellbore, such as a main wellbore. Moreover, a lateral wellbore may have another lateral wellbore drilled outwardly therefrom. In the illustrated embodiment, the lateral wellbore 160 includes a lateral wellbore liner 170. Accordingly, a junction 180 exists where the main wellbore 140 (e.g., the casing string 150) and the lateral wellbore 160 (e.g., the lateral wellbore liner 170) intersect. In accordance with at least one embodiment of the disclosure, cement surrounds the junction 180. In accordance with another embodiment of the disclosure, a valved wiper plug assembly 190 (e.g., a frangible or drillable valved wiper plug assembly) may be positioned somewhere in the lateral wellbore liner 170. Accordingly, the valved wiper plug assembly 190 may collect any cement and/or debris that may fall into the lateral wellbore liner 170 during or after the cement is placed at the junction 180.

What results, in one or more embodiments, is a Technology Advancement of MultiLaterals ("TAML") Level 4 junction. A TAML Level 4 junction specifies a cement main well bore and lateral wellbore with cement at the junction to provide mechanical support. In other words, cement is to remain around the junction after the lateral liner has been deployed and cemented in place in order to provide mechanical stability and support.

Aspects of the present disclosure:

- Incorporate a wiper plug assembly and cementing plug to cleanly displace cement through/from casing.
- Allow for use of dual wiper plug in case a multi-stage cementing operation is desired.
- Attachment holes may allow other tools/devices/sensors/etc. to be adapted to the assembly.
- Long stinger so other tools may be utilized above the valved wiper plug assembly.
- A method, system, and device to create a TAML Level 4 junction and ensure cement remains around the junction (main wellbore+lateral wellbore intersection).
- System to run and land a lateral liner assembly in a lateral wellbore. The system includes two or more components that may be milled (removed) to provide full access to the lateral liner assembly after cementing occurs. In addition, the system may provide full bore access to the main wellbore casing below the junction.
- The ability to do the above, plus prevent cement from falling back into the lateral liner assembly after the lateral liner running tool is removed.
- Valved wiper plug assembly is drillable so full-bore access through the lateral liner assembly can be restored after the cementing process.
- Exterior sealing/isolation elements may be incorporated in the system to reduce/prevent cement from falling back down the annulus between the lateral liner assembly and the wellbore casing. The isolation elements may include one or more: inflatable packer; expandable packer; solidifying barrier (cement, expandable metal); expanding isolation system; cement basket; barrier of any kind; large obstruction of any kind.

Figure 2A:
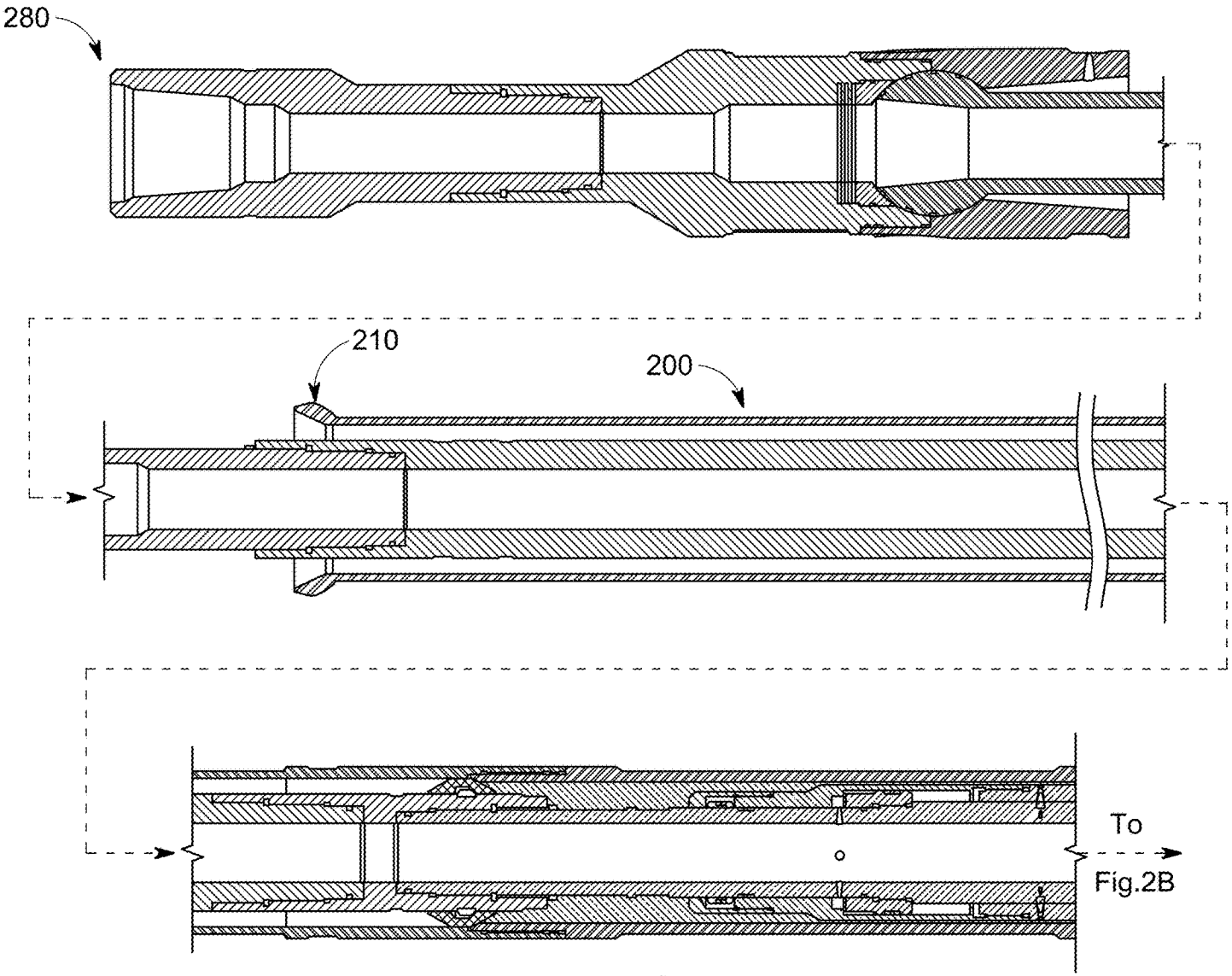
FIGS. 2A through 2C illustrate a lateral liner assembly, the lateral liner assembly having a valved wiper plug assembly being run therein using a lateral liner running tool, all of which have been designed, manufactured and operated according to one or more embodiments of the disclosure.
Figure 2B:
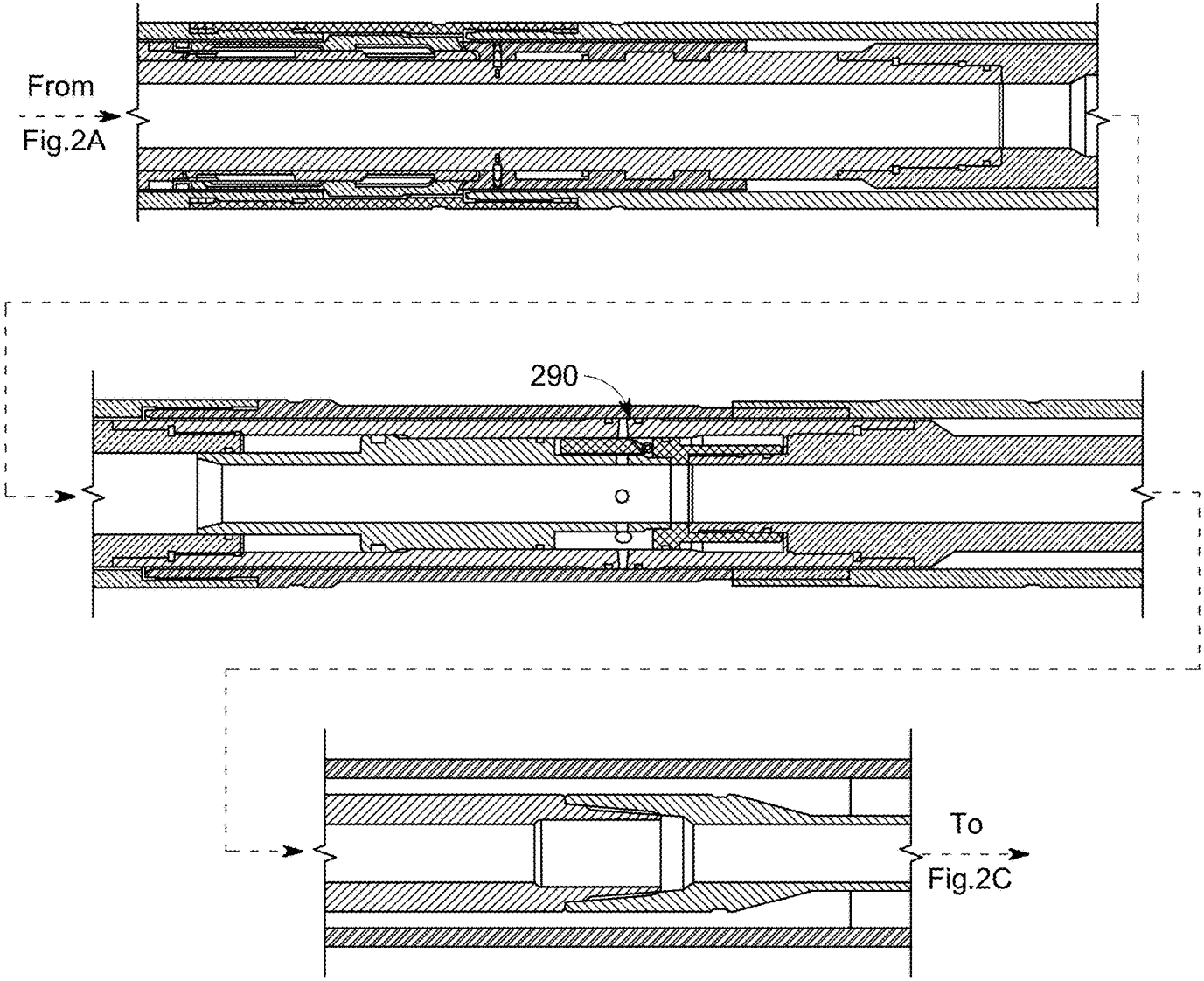
Figure 2C:
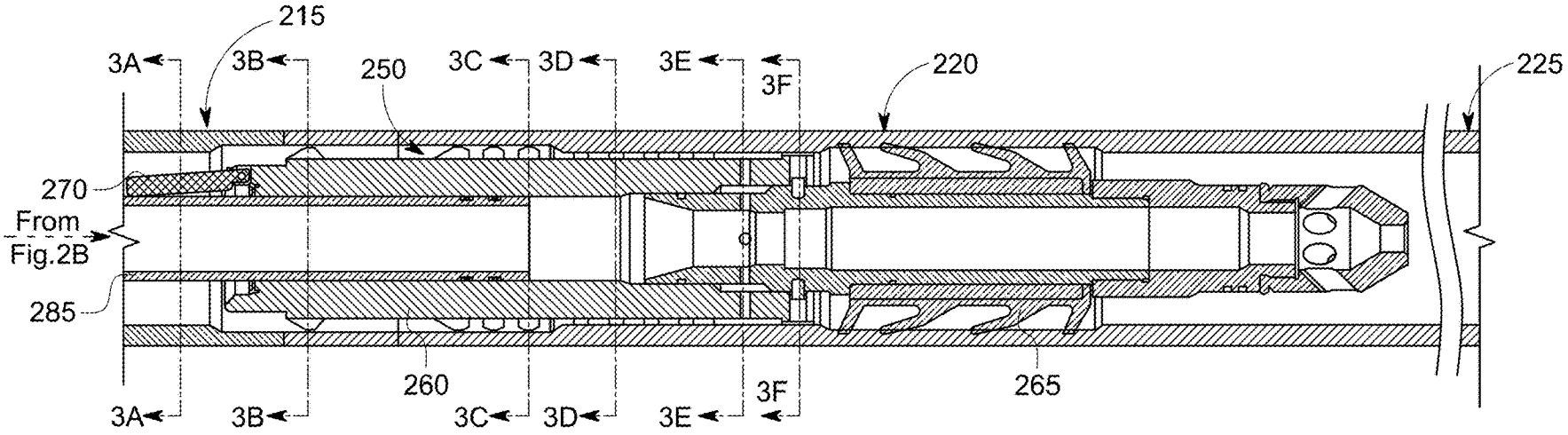

Turning to FIGS. 2A through 2C, illustrated is a lateral liner assembly 200, the lateral liner assembly 200 having a valved wiper plug assembly 250 being run therein using a lateral liner running tool 280, all of which have been designed, manufactured and operated according to one or more embodiments of the disclosure. The lateral liner assembly 200, in at least one embodiment, includes a transition joint section 210, an upper sub section 215, a lower sub section 220, and a lateral liner section 225. In the illustrated embodiment, the valved wiper plug assembly 250 is positioned at a bottom section of the lateral liner running tool 280. Further to the embodiment of FIGS. 2A through 2C, the valved wiper plug assembly 250 is positioned proximate (e.g., between) the upper sub section 215 and the lower sub section 220 of the lateral liner assembly 200.

In at least one embodiment, the valved wiper plug assembly 250 may include a valved housing 260, as well as a wiper plug assembly 265 coupled to the downhole end of the valved housing 260. In at least one embodiment, the valved housing 260 includes a flapper valve 270, the flapper valve 270 configured to move from an open state to a closed state when a stinger 285 of the lateral liner running tool 280 is pulled therefrom. Additional details relating to the valved wiper plug assembly 250 will be discussed below. It should be noted, however, that while the valved wiper plug assembly 250 is located a good distance within the lateral liner assembly 200, in one or more other embodiments the valved wiper plug assembly 250 could be located near the transition joint section 210 of the lateral liner assembly 200. In the illustrated embodiment, the lateral liner running tool 280 may additionally include an axial/torsional force transmission section 290.

Figure 3B:
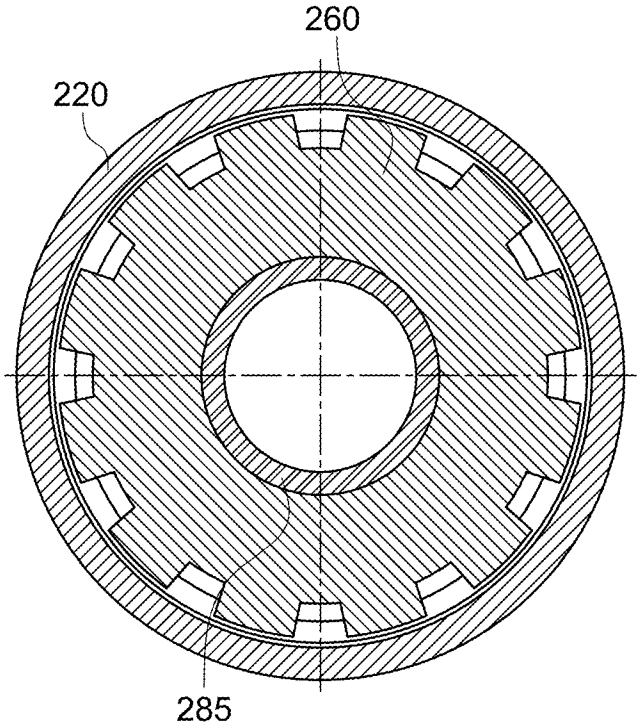
FIGS. 3A through 3F illustrate various different cross-sectional views of the lateral liner assembly, valved wiper plug assembly, and lateral liner running tool illustrated in FIGS. 2A through 2C taken through the cross-section lines A-A, B-B, C-C, D-D, E-E and F-F, respectively.
Figure 3A:
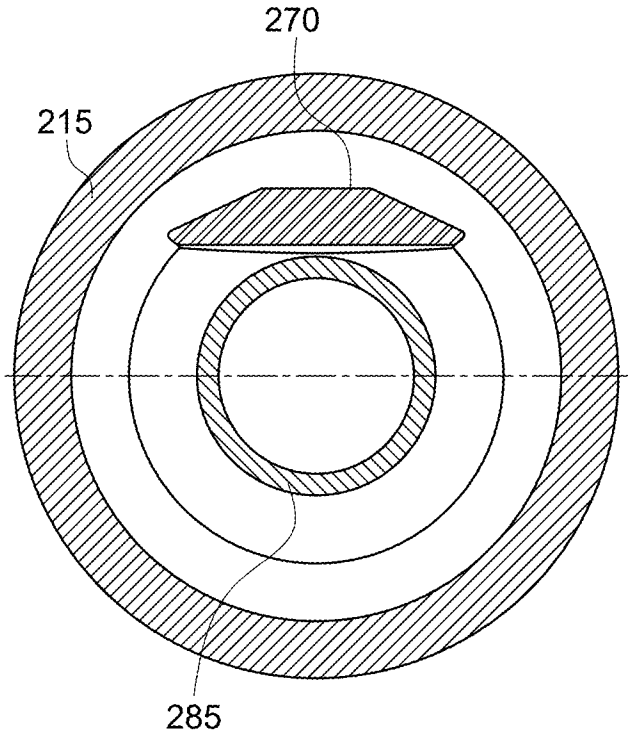
Figure 3D:
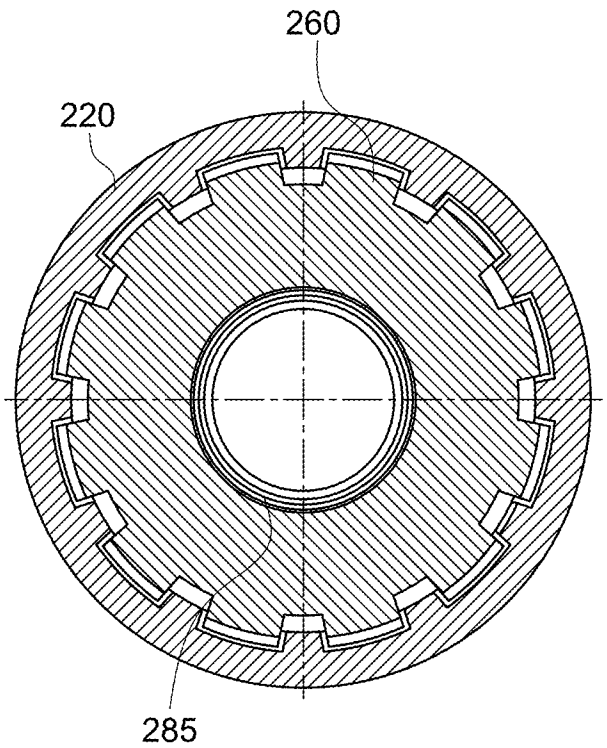
Figure 3C:
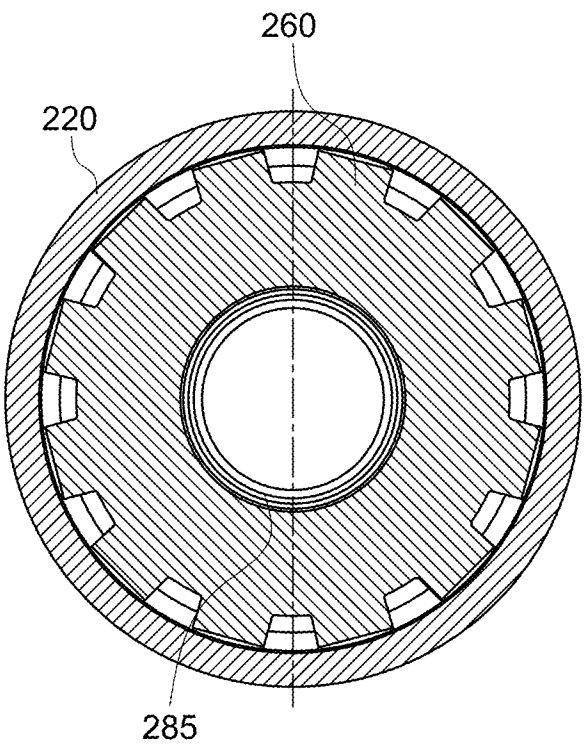
Figure 3F:
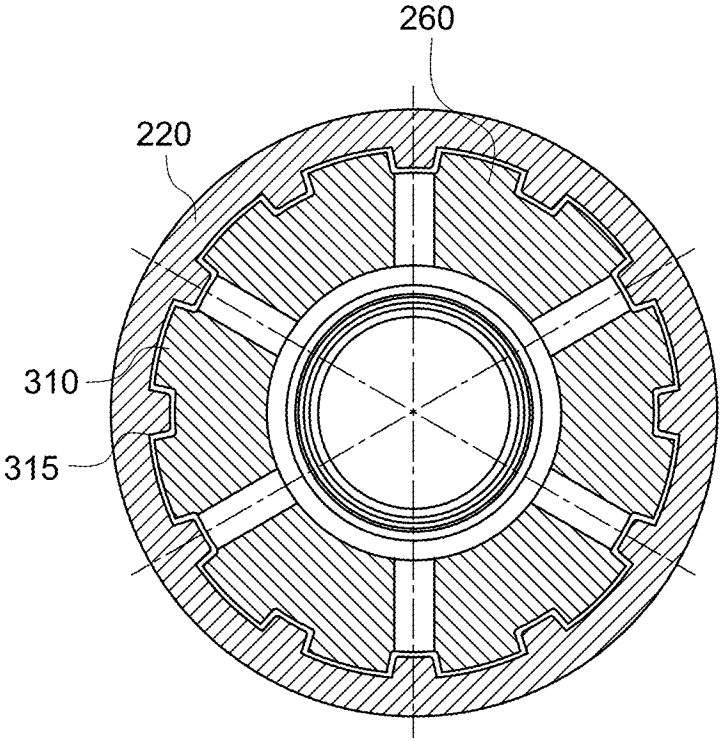
Figure 3E:
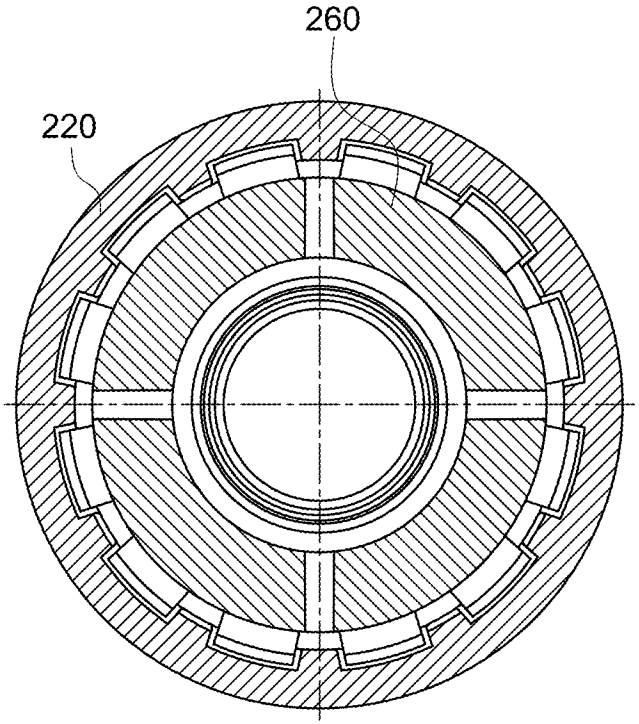

Turning to FIGS. 3A through 3F, illustrated are various different cross-sectional views of the lateral liner assembly 200, valved wiper plug assembly 250, and lateral liner running tool 280 illustrated in FIGS. 2A through 2C taken through the cross-section lines A-A, B-B, C-C, D-D, E-E and F-F, respectively. FIG. 3F illustrates the one or more associated slots 315 that the one or more housing torque lugs 310 engage with.

Figure 4A:
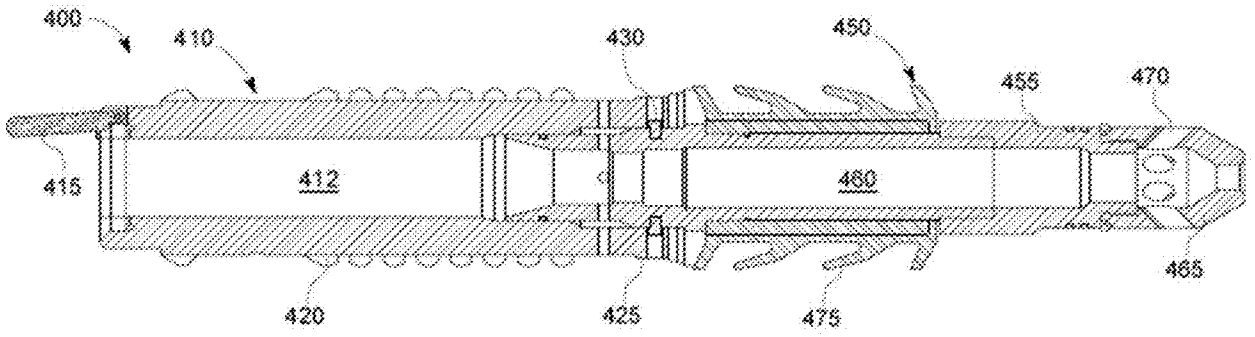

Turning to FIG. 4A, illustrated is a cross-sectional view of one embodiment of a valved wiper plug assembly 400 designed, manufactured and operated according to one or more embodiments of the disclosure. The valved wiper plug assembly 400, in the illustrated embodiment, includes a valved housing 410 having a wiper plug assembly 450 coupled proximate a downhole end thereof. The valved housing 410 may comprise many different materials and/or shapes while remaining within the scope of the present disclosure. Nevertheless, in at least one embodiment, the valved housing 410 has a through bore 412 extending entirely therethrough. In at least one embodiment, however, the valved housing 410 is a drillable valved housing, and thus comprises a material that may be drilled out when necessary. Accordingly, the valved housing 410 may provide full-bore access through the lateral liner after completing the cementing process.

Figure 4B:
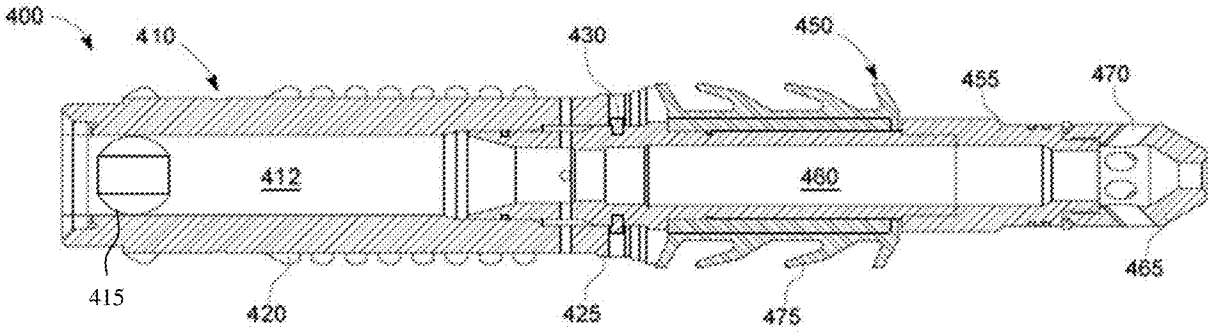
FIG. 4B illustrates a cross-sectional view of an alternative embodiment of a valved wiper plug assembly employing a ball valve.
Figure 4C:
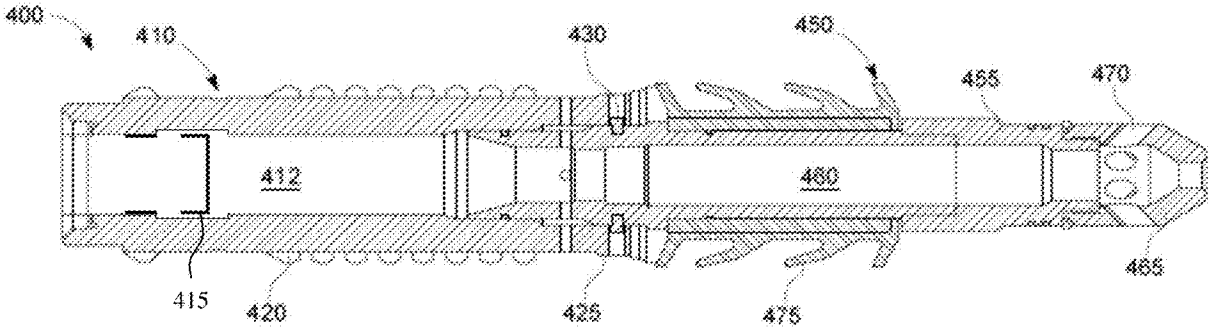

In the illustrated embodiment, the valved housing 410 has a valve member 415 associated therewith. The valve member 415 may embody many different valves and remain within the scope of the disclosure. In the illustrated embodiment of FIG. 4A, the valve member 415 is a flapper valve. For example, the flapper valve could be a durable, but frangible and/or drillable flapper valve (e.g., a ceramic flapper valve) in one or more embodiments. In other embodiments, the valve member 415 is a ball valve (FIG. 4B), a sliding sleeve (FIG. 4C), a dissolvable device (FIG. 4A), a disappearing device, a retrievable or releasable device that may be pulled from the lateral liner or pushed to the bottom of the well, and a debris basket, among others.

In the illustrated embodiment, the valved housing 410 includes one or more housing centralizers 420 coupled to an outside diameter thereof. The housing centralizers 420, in one or more embodiments, may engage with associated alignment grooves in the bottom sub of the lateral liner assembly within which it will eventually fit. The housing centralizers 420, in at least one embodiment, rotationally fix the valved housing 410 within the bottom sub. The valved housing 410, in one or more embodiments, may additionally include one or more housing torque lugs 425, as well as one or more shear features 430 (e.g., shear screws) for attaching the valved housing 410 to the wiper plug assembly 450.

The wiper plug assembly 450, in the illustrated embodiment, includes a wiper plug housing 455 having a through bore 460 extending entirely therethrough. The through bore 460, in the illustrated embodiment, is coupled to a bull nose 465 having one or more openings 470 therein. Thus, in one or more embodiments, cement may be pumped downhole through the through bore 412 in the valve housing 410, through the through bore 460 in the wiper plug housing 455, and out the one or more openings 470 in the bull nose 465 and into the lateral liner assembly. The wiper plug assembly 450 may additionally include one or more wipers 475 (e.g., two or more circumferential wipers in the illustrated embodiment) for wiping the inside diameter (ID) of the lateral liner assembly as it moves downhole.

Figure 5A:
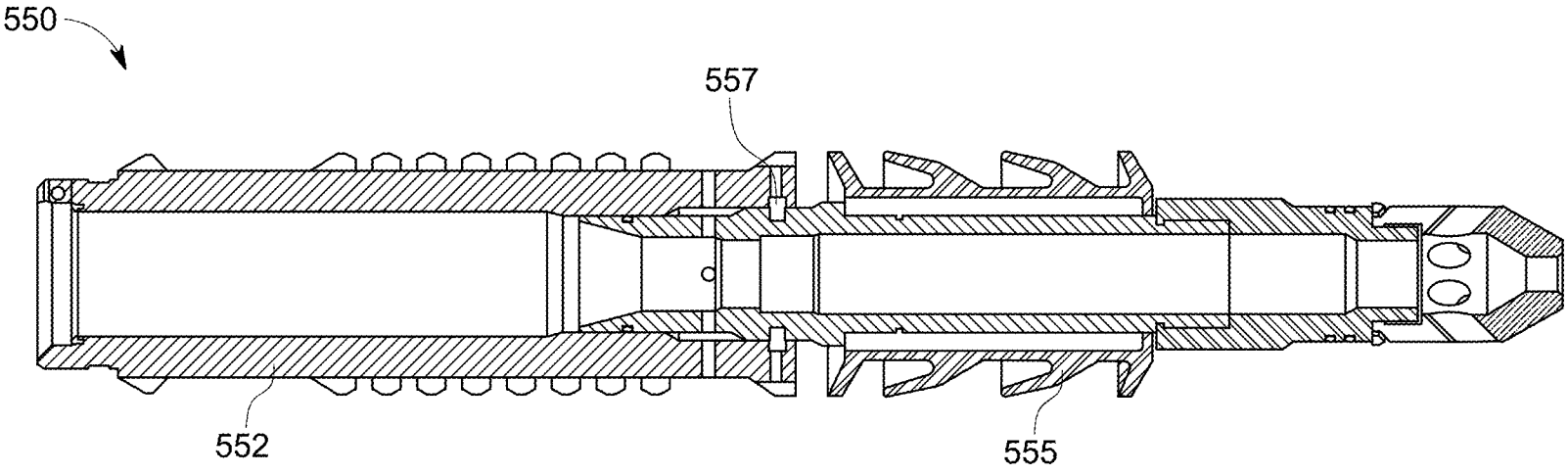

Turning to FIGS. 5A through 5I illustrated are sectional views of one embodiment for completing and/or assembling a lateral liner assembly 500, valved wiper plug assembly 550, and lateral liner running tool 580 according to one or more embodiments of the disclosure. With reference to FIG. 5A, a valved housing 552 of the valved wiper plug assembly 550 may be coupled with a wiper plug assembly 555 of the valved wiper plug assembly 550, for example using one or more shear features 557.

Figure 5B:
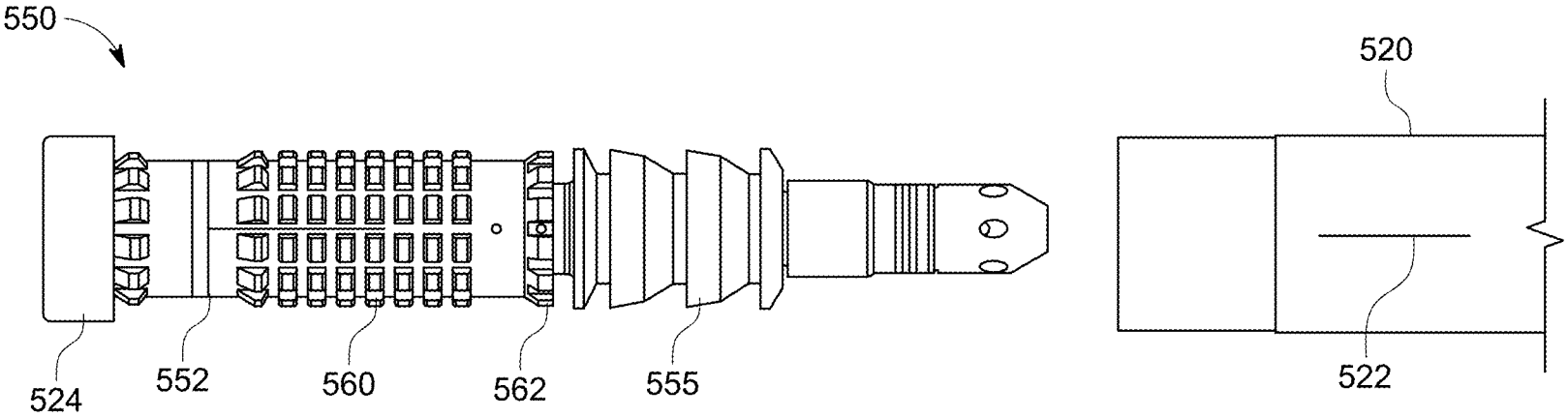

With reference to FIG. 5B, the valved wiper plug assembly 550 may be installed within a bottom sub 520 of a lateral liner assembly 500. For example, circumferentially spaced apart housing centralizers 560 on an outside diameter of the valved housing 552 may engage with one or more alignment grooves 522 on an inside diameter in the bottom sub 520, to rotationally position the valved housing 552 within the bottom sub 520. Similarly, one or more housing torque lugs 562 coupled to an outside diameter of the valved housing 552 may engage with one or more associated slots formed in an inside diameter of the bottom sub 520, for example to rotationally/torsionally fix the two relative to one another. Additionally, an installation ring 524 may engage (e.g., threadingly engage) with the valved housing 552 and the bottom sub 520 to axially fix the valved housing 552 with the bottom sub 520.

Figure 5C:
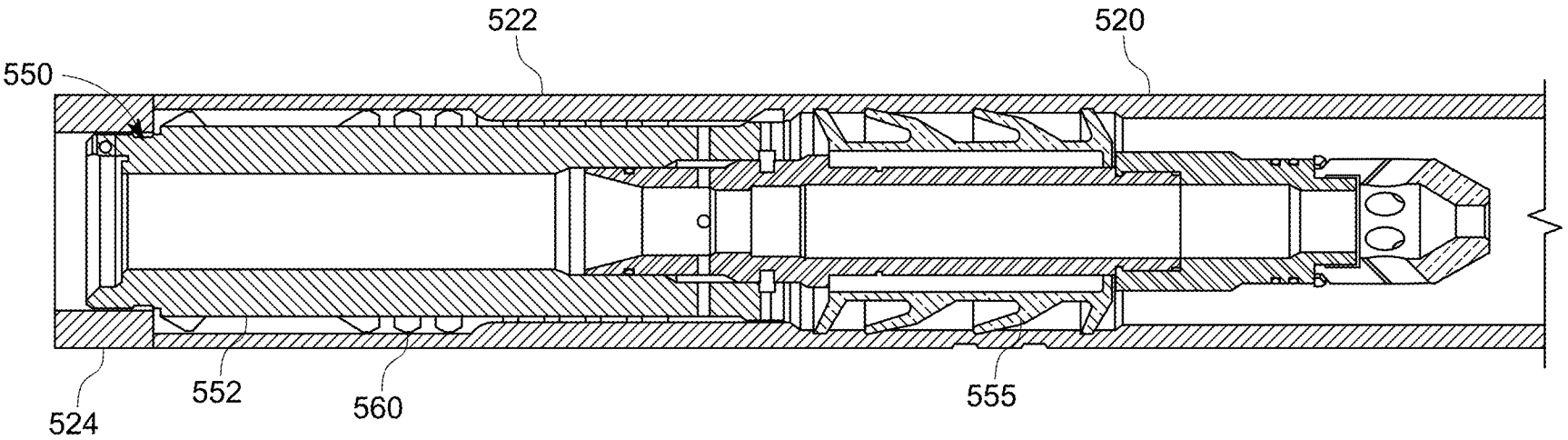
Figure 5D:
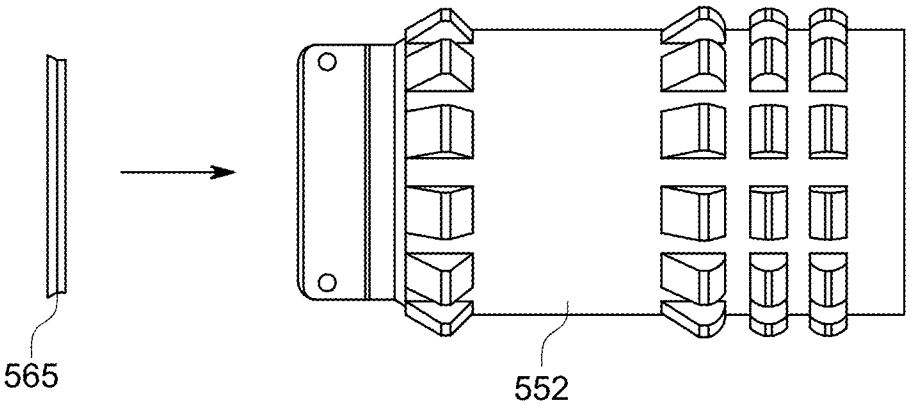

With reference to FIG. 5C, the housing centralizers 560 should line up with the one or more alignment grooves 522, or the valved housing 552 will not fit in the bottom sub 520 correctly. With reference to FIG. 5D, a flapper seat 565 may be placed within the valved housing 552.

Figure 5E:
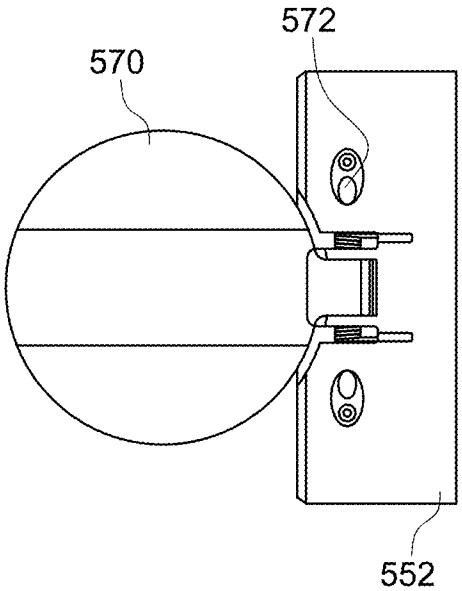
Figure 5F:
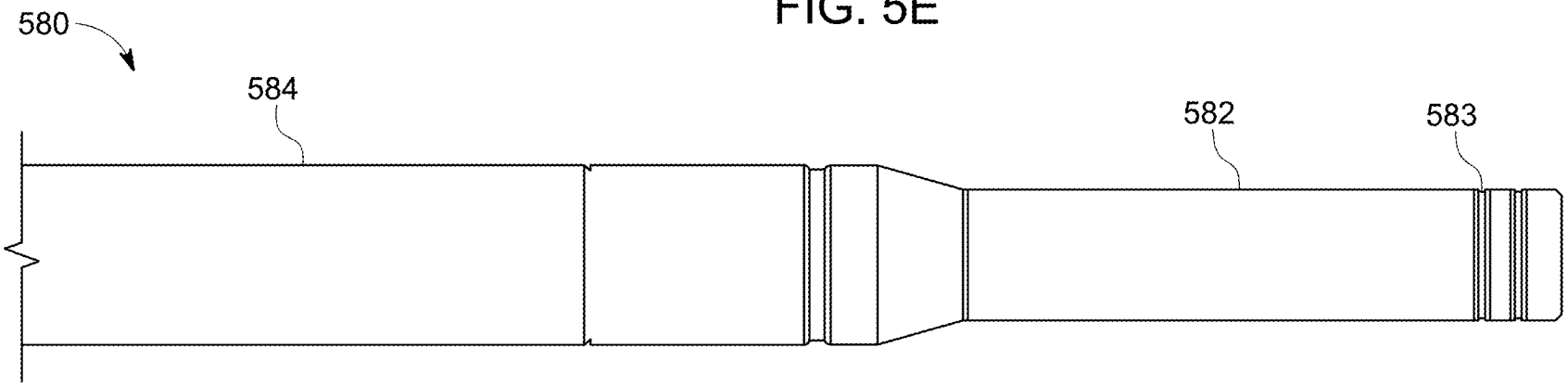

With reference to FIG. 5E, a flapper valve 570 may be placed on the flapper seat 565. Thereafter, holes in each of the parts may be aligned, and then a pin 572 may be inserted therein. With reference to FIG. 5F, a stinger 582 of the lateral liner running tool 580 may be coupled with a crossover sub 584 (e.g., three-way crossover) of the lateral liner running tool 580. In the illustrated embodiment, the stinger 582 includes one or more seals 583 circumferentially placed about an outside diameter thereof.

Figure 5G:
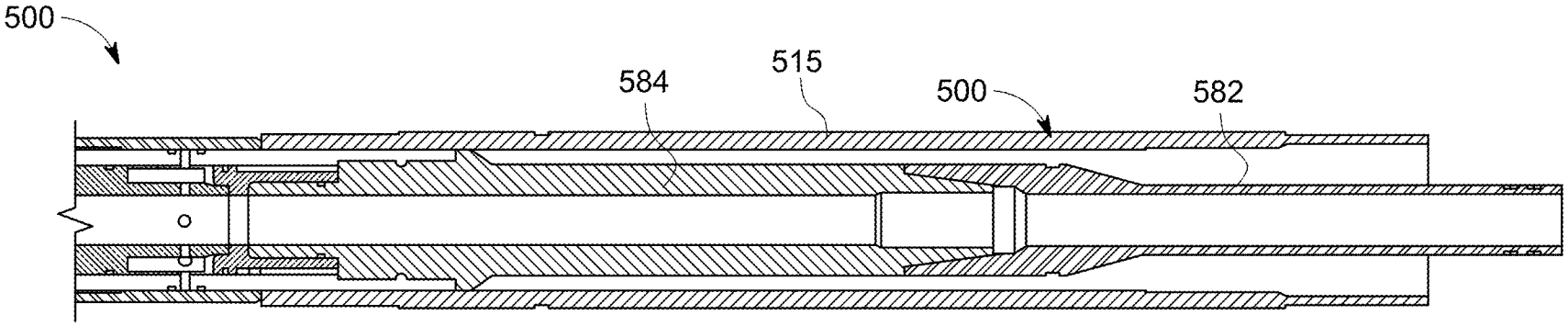
Figure 5H:
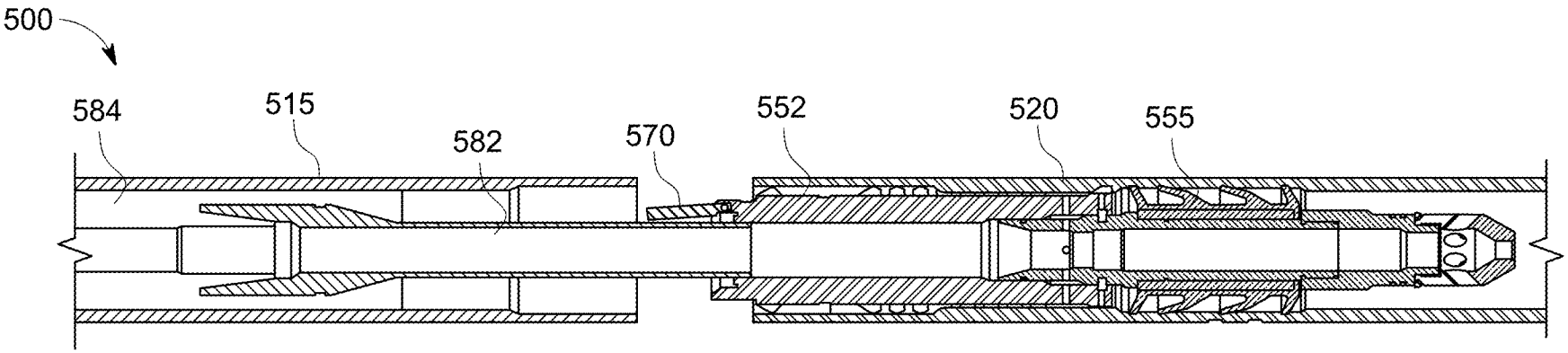
Figure 5I:
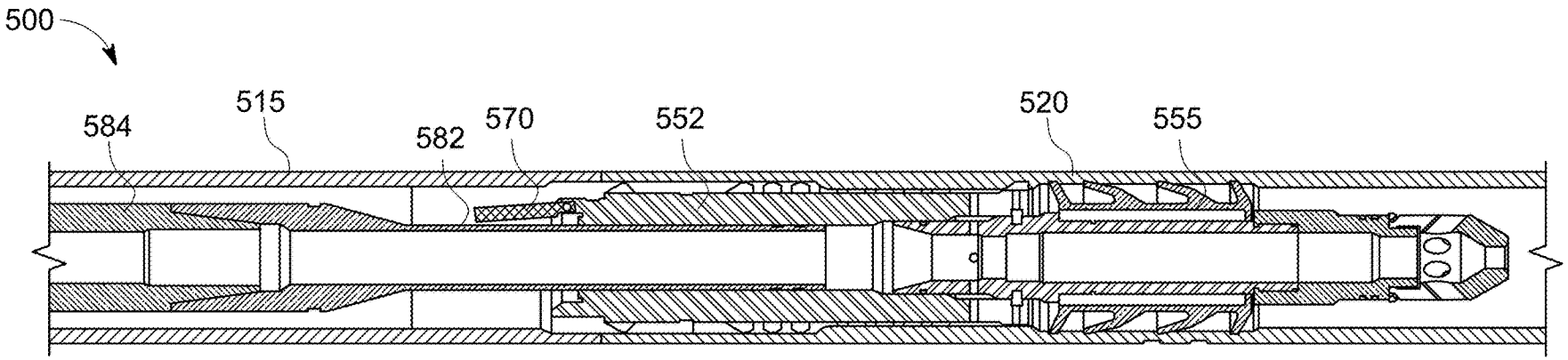

Turning to FIG. 5G, the stinger 582 and crossover sub 584 of the lateral liner running tool 580 may be coupled to the top sub 515 of the lateral liner assembly 500. For example, in at least one embodiment the crossover sub 584 threadingly engages with the top sub 515. In one other embodiment, the crossover sub 584 is releasably connected to top sub 515, so that the crossover sub 584, stinger 582 and liner running tool 580 may be released from the components of lateral liner assembly 500 and withdrawn from the wellbore while leaving lateral liner assembly 500 in the wellbore. Turning to FIG. 5H, the flapper valve 570 may be lifted, and then the stinger 582 inserted within the valved housing 552. Turning to FIG. 5I, the top sub 515 may be brought into contact with and engage with the bottom sub 520. In at least one embodiment, the top sub 515 is threaded with the bottom sub 520. At this stage, the valved wiper plug assembly 550 and the lateral liner running tool 580 are appropriately positioned within the lateral liner assembly 500.

Figure 6A:
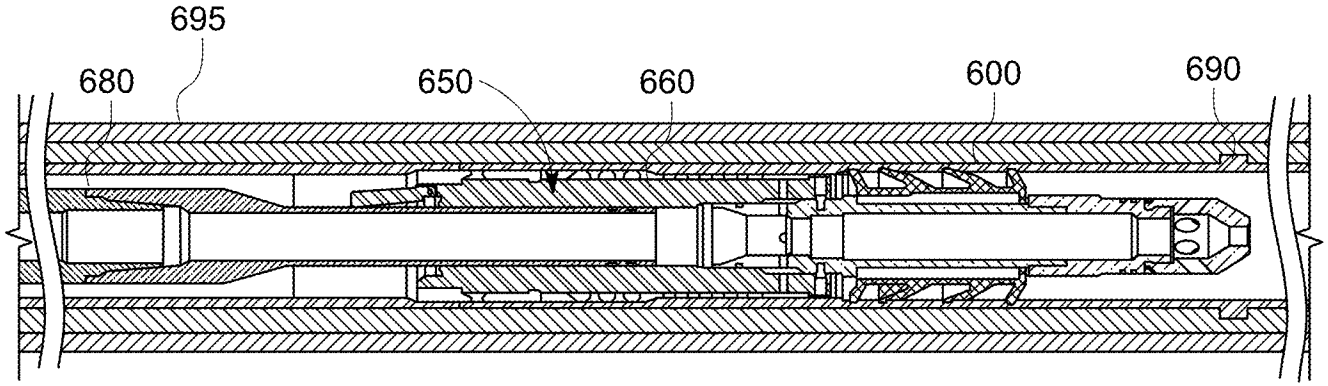

Turning now to FIGS. 6A through 6F, illustrated are sectional views of an embodiment of a method for cementing a lateral liner assembly 600, for example employing a valved wiper plug assembly 650, and lateral liner running tool 680 according to one or more aspects of the disclosure. With reference to FIG. 6A, the lateral liner assembly 600, valved wiper plug assembly 650, and lateral liner running tool 680 are run-in-hole within wellbore casing 695. In at least one embodiment, an isolation element 690 is positioned in an annulus between the lateral liner assembly 600 and the wellbore 695, and then the lateral liner assembly 600 is set in place within the wellbore 695.

The isolation element 690, in one or more embodiments, may comprise an inflatable packer, a swellable packer or an expandable metal packer, while remaining within the scope of the disclosure. The expandable metal, in some embodiments, may be described as expanding to a cement like material. In other words, the expandable metal goes from metal to micron-scale particles and then these particles expand and lock together to, in essence, seal two or more surfaces together. The reaction may, in certain embodiments, occur in less than 2 days in a reactive fluid and in certain temperatures. Nevertheless, the time of reaction may vary depending on the reactive fluid, the expandable metal used, the downhole temperature, and surface-area-to-volume ratio (SA:V) of the expandable metal.

In some embodiments, the reactive fluid may be a brine solution such as may be produced during well completion activities, and in other embodiments, the reactive fluid may be one of the additional solutions discussed herein. The expandable metal is electrically conductive in certain embodiments. The expandable metal, in certain embodiments, has a yield strength greater than about 8,000 psi, e.g., 8,000 psi+/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, boehmite, aluminum oxide, and norstrandite, depending on form. The possible hydration reactions for aluminum are:

$$Al+3H_2O \rightarrow Al(OH)_3+3/2H_2.$$

$$Al+2H_2O \rightarrow Al\ O(OH)+3/2H_2$$

$$Al+3/2H_2O \rightarrow ½Al_2O_3+3/2H_2$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, Ca, etc.) work well for the expandable metal, but transition metals (Al, etc.) also work well for the expandable metal. In one embodiment, the metal hydroxide is dehydrated by the swell pressure to form a metal oxide.

In at least one embodiment, the expandable metal is a non-graphene based expandable metal. By non-graphene based material, it is meant that is does not contain graphene, graphite, graphene oxide, graphite oxide, graphite intercalation, or in certain embodiments, compounds and their derivatized forms to include a function group, e.g., including carboxy, epoxy, ether, ketone, amine, hydroxy, alkoxy, alkyl, aryl, aralkyl, alkaryl, lactone, functionalized polymeric or oligomeric groups, or a combination comprising at least one of the forgoing functional groups. In at least one other embodiment, the expandable metal does not include a matrix material or an exfoliatable graphene-based material. By not being exfoliatable, it is meant that the expandable metal is not able to undergo an exfoliation process. Exfoliation as used herein refers to the creation of individual sheets, planes, layers, laminae, etc. (generally, "layers") of a graphene-based material; the delamination of the layers; or the enlargement of a planar gap between adjacent ones of the layers, which in at least one embodiment the expandable metal is not capable of.

In yet another embodiment, the expandable metal does not include graphite intercalation compounds, wherein the graphite intercalation compounds include intercalating agents such as, for example, an acid, metal, binary alloy of an alkali metal with mercury or thallium, binary compound of an alkali metal with a Group V element (e.g., P, As, Sb, and Bi), metal chalcogenide (including metal oxides such as, for example, chromium trioxide, $PbO_2$, $MnO_2$, metal sulfides, and metal selenides), metal peroxide, metal hyperoxide, metal hydride, metal hydroxide, metals coordinated by nitrogenous compounds, aromatic hydrocarbons (benzene, toluene), aliphatic hydrocarbons (methane, ethane, ethylene, acetylene, n-hexane) and their oxygen derivatives, halogen, fluoride, metal halide, nitrogenous compound, inorganic compound (e.g., trithiazyl trichloride, thionyl chloride), organometallic compound, oxidizing compound (e.g., peroxide, permanganate ion, chlorite ion, chlorate ion, perchlorate ion, hypochlorite ion, $As_2O_5$, $N_2O_5$, $CH_3ClO_4$, $(NH_4)_2S_2O_8$, chromate ion, dichromate ion), solvent, or a combination comprising at least one of the foregoing. Thus, in at least one embodiment, the expandable metal is a structural solid expanded metal, which means that it is a metal that does not exfoliate and it does not intercalate. In yet another embodiment, the expandable metal does not swell by sorption.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof. The metal alloy can be a mixture of the metal and metal oxide. For example, a powder mixture of aluminum and aluminum oxide can be ball-milled together to increase the reaction rate.

Optionally, non-expanding components may be added to the starting metallic materials. For example, ceramic, elastomer, plastic, epoxy, glass, or non-reacting metal components can be embedded in the expandable metal or coated on the surface of the expandable metal. In yet other embodiments, the non-expanding components are metal fibers, a composite weave, a polymer ribbon, or ceramic granules, among others. Alternatively, the starting expandable metal may be the metal oxide. For example, calcium oxide (CaO) with water will produce calcium hydroxide in an energetic reaction. Due to the higher density of calcium oxide, this can have a 260% volumetric expansion (e.g., converting 1 mole of CaO may cause the volume to increase from 9.5 cc to 34.4 cc). In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for sealing the annulus. For example, the expandable metal may be formed into a single long member, multiple short members, rings, among others. In another embodiment, the expandable metal may be formed into a long wire of expandable metal, which can be in turn be wound around a tubular as a sleeve. The wire diameters do not need to be of circular cross-section, but may be of any cross-section. For example, the cross-section of the wire could be oval, rectangle, star, hexagon, keystone, hollow braided, woven, twisted, among others, and remain within the scope of the disclosure. In certain other embodiments, the expandable metal is a collection of individual separate chunks of the metal held together with a binding agent. In yet other embodiments, the expandable metal is a collection of individual separate chunks of the metal that are not held together with a binding agent, but held in place using one or more different techniques.

Additionally, a delay coating or protective layer may be applied to one or more portions of the expandable metal to delay the expanding reactions. In one embodiment, the material configured to delay the hydrolysis process is a fusible alloy. In another embodiment, the material configured to delay the hydrolysis process is a eutectic material. In yet another embodiment, the material configured to delay the hydrolysis process is a wax, oil, or other non-reactive material.

Figure 6B:
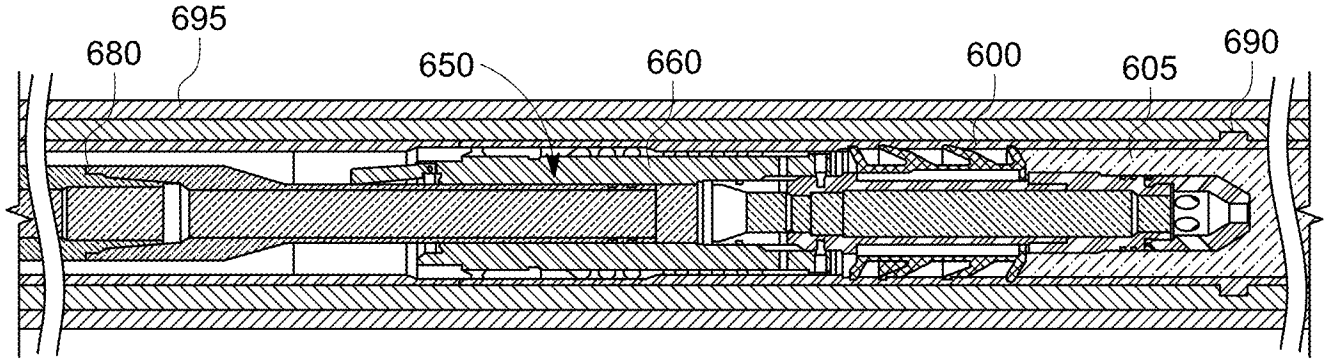

Turning to FIG. 6B, illustrated is a sectional view of the lateral liner assembly 600, valved wiper plug assembly 650, and lateral liner running tool 680 of FIG. 6A after pumping cement 605 downhole through the lateral liner running tool 680, and through and downhole of the valved wiper plug assembly 650.

Figure 6C:
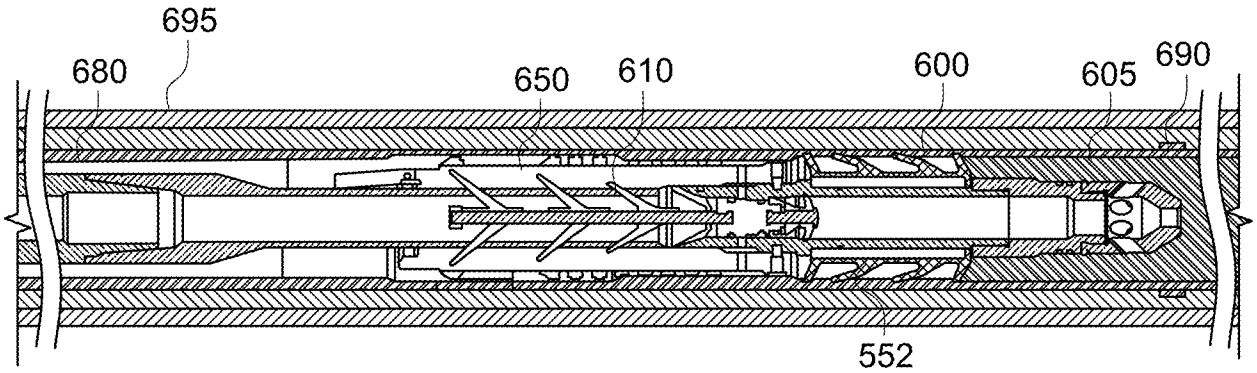

Turning to FIG. 6C, illustrated is a sectional view of the lateral liner assembly 600, valved wiper plug assembly 650, and lateral liner running tool 680 of FIG. 6B after landing a dart 610 in the valved wiper plug assembly 650, and more particularly in the wiper plug assembly 655 of the valved wiper plug assembly 650. The dart 610, in the illustrated embodiment, pushes the cement 605 in the lateral liner running tool 680 downhole of the valved wiper plug assembly 650.

Figure 6D:
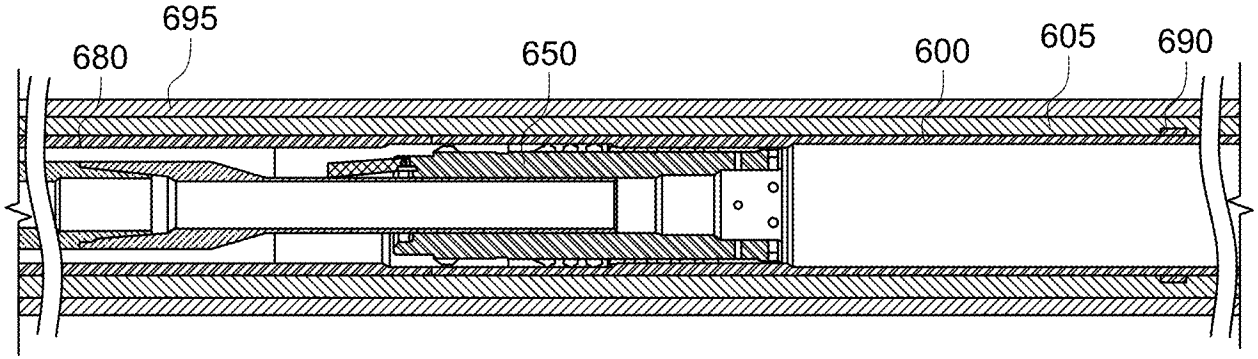

Turning to FIG. 6D, illustrated is a sectional view of the lateral liner assembly 600, valved wiper plug assembly 650, and lateral liner running tool 680 of FIG. 6C after pressuring down on the dart 610 to shear the wiper plug assembly 655 from the valved housing 660. The pressure causes the wiper plug assembly 655 to move downhole until it hits a stop, or bumps the plug. Similarly, the downhole movement of the wiper plug assembly 655 causes the cement 605 to move into the annulus between the lateral liner assembly 600 and the wellbore 695 and out of the lateral line assembly 650. Thereafter, the cement 605 may be allowed to cure, and then may be tested for leaks.

Figure 6E:
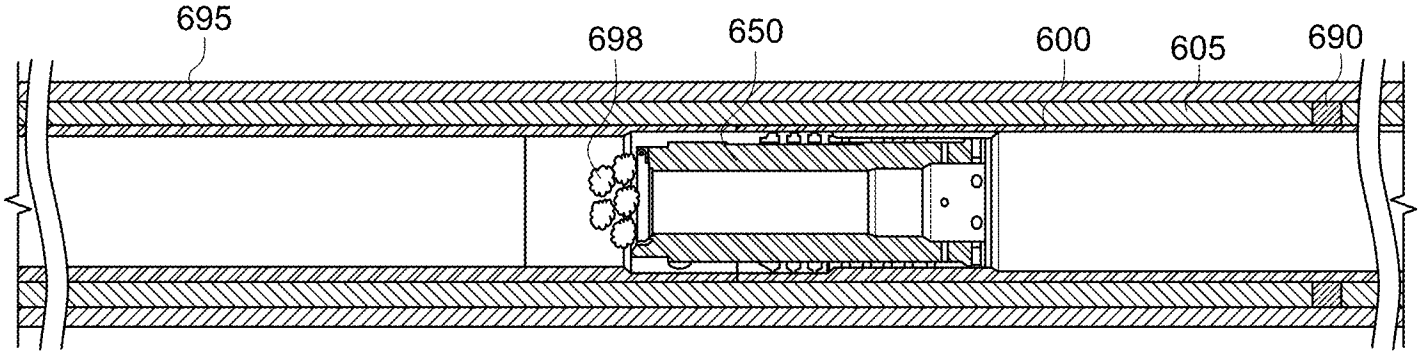

Turning to FIG. 6E, illustrated are cross-sectional views of the lateral liner assembly 600, valved wiper plug assembly 650, and lateral liner running tool 680 of FIG. 6D after setting the isolation element 690, and pulling the lateral liner running tool 680 from the valved wiper plug assembly 650. As discussed above, the pulling of the lateral liner running tool 680 allows the flapper valve of the valved wiper plug assembly 650 to move (e.g., rotate downhole) from the open state (e.g., uphole state) to the closed state (e.g., downhole state). Accordingly, any subsequent debris 698 (e.g., including uncured cement, cured cement, cured cement fragments, metal fragments, as well as any other debris created during the washover process) traversing from uphole to downhole would subsequently be caught by the closed valved wiper plug assembly 650. Moreover, in at least one embodiment, the valved wiper plug assembly 650 would still allow fluid to travel therethrough from downhole to uphole.

Figure 6F:
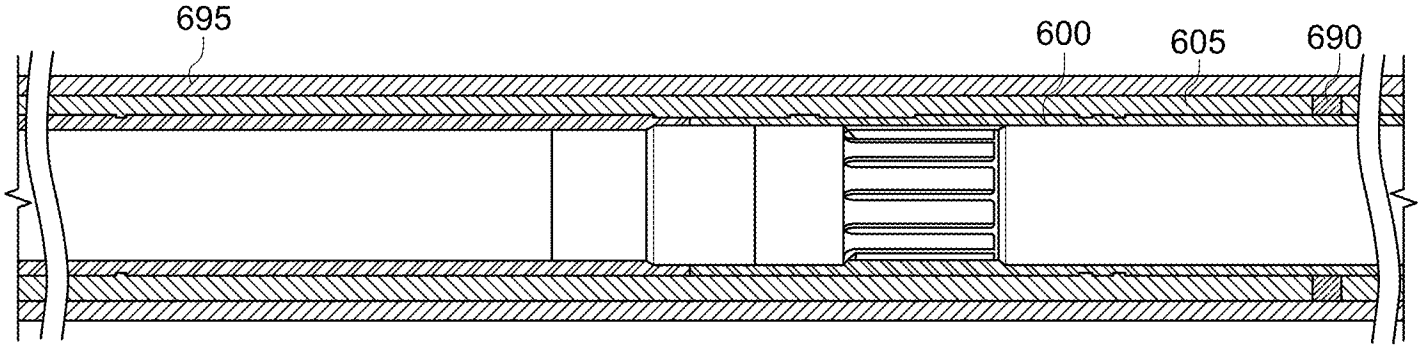

Turning to FIG. 6F, illustrated are cross-sectional views of the lateral liner assembly 600 after the junction is properly cemented, and the valved wiper plug assembly 650 has been removed. In at least one embodiment, the valved wiper plug assembly 650 is removed by drilling and/or milling it out, for example in the same clean out step as is used to clean the junction between the main wellbore and the lateral wellbore. At this stage, full wellbore access may be achieved.

Aspects disclosed herein include:

A. A valved wiper plug assembly, the valved wiper plug assembly including: 1) a valved housing; 2) a valve member coupled to the valved housing, the valve member configured to move between an open state to allow cementing and a closed state to catch debris falling from uphole of the valved housing; and 3) a wiper plug assembly coupled to the valve housing proximate a downhole end of the valved housing.

B. A well system, the well system including: 1) a main wellbore; 2) a lateral wellbore extending from the main wellbore; 3) a lateral liner assembly positioned within the lateral wellbore proximate a junction between the main wellbore and the lateral wellbore; and 4) a valved wiper plug assembly coupled with the lateral liner assembly, the valved wiper plug assembly including: a) a valved housing; b) a valve member coupled to the valved housing, the valve member configured to move between an open state to allow cementing and a closed state to catch debris falling from uphole of the valved housing; and c) a wiper plug assembly coupled to the valved housing proximate a downhole end of the valved housing.

C. A method for cementing a lateral liner assembly, the method including: 1) positioning a lateral liner assembly within a lateral wellbore proximate a junction between a main wellbore and the lateral wellbore, the lateral liner assembly having a valved wiper plug assembly coupled therewith, the valved wiper plug assembly including: a) a valved housing; b) a valve member coupled to the valved housing, the valve member configured to move between an open state to allow cementing and a closed state to catch debris falling from uphole of the valved housing; and c) a wiper plug assembly coupled to the valved housing proximate a downhole end of the valved housing; 2) pumping cement through a lateral liner running tool coupled to the lateral liner assembly, through the valved wiper plug assembly, and into an annulus between the lateral liner assembly and the lateral wellbore; and 3) withdrawing the lateral liner running tool to allow the valve member to move from the open state to the closed state.

Aspects A, B, and C may have one or more of the following additional elements in combination: Element 1: further including a shear feature coupling the wipe plug assembly proximate the downhole end of the valved housing. Element 2: wherein the valve member is a flapper valve. Element 3: wherein the flapper valve is configured to rotate downhole when moving from the open state to the closed state. Element 4: wherein the valve member is a ball valve, a sliding sleeve or a dissolvable member. Element 5: wherein the valved housing, valve member, and wiper plug assembly are positioned within a bottom sub. Element 6: further including an installation ring engaged proximate an upper end of the bottom sub, the installation ring configured to axially fix the valved housing within the bottom sub. Element 7: further including one or more housing torque lugs coupled to an outside diameter of the valved housing, the one or more housing torque lugs engaged with one or more associated slots formed in an inside diameter of the bottom sub. Element 8: further including a plurality of circumferentially spaced apart housing centralizers coupled to an outside diameter of the valved housing, the plurality of spaced apart housing centralizers engaged with an inside diameter of the bottom sub to centralize the valved housing within the bottom sub. Element 9: wherein the wiper plug assembly includes two or more circumferentially placed wipers, the two or more circumferentially placed wipers configured to wipe an inside diameter of a tubular the wipe plug assembly is configured to traverse. Element 10: further including a lateral liner running tool coupled to the lateral liner assembly. Element 11: wherein the lateral liner running tool includes a crossover sub having a stinger coupled to a downhole end thereof. Element 12: wherein the stinger is located within the valved housing propping the valve member in the open state. Element 13: wherein the stinger includes one or more seals circumferentially placed about an outside diameter thereof, the one or more seals engaged with an inside diameter of the valved housing when the stinger is located therein. Element 14: further including landing a dart in the valved wiper plug assembly after pumping cement, the dart pushing the cement through the valved wiper plug assembly and out of the wiper plug assembly. Element 15: wherein the wiper plug assembly is removably coupled to the downhole end of the valved housing using a shear feature, and further including pressuring down on the dart to shear the shear feature, the sheared wiper plug assembly moving downhole to push the cement into the annulus. Element 16: wherein the withdrawing occurs after the pressuring down on the dart. Element 17: further including assembling the valved wiper plug assembly prior to positioning the lateral liner assembly within the lateral wellbore, the assembling including: positioning the valved housing, valve member, and wiper plug assembly within a bottom sub; and coupling the lateral liner assembly to the bottom sub of the valved wiper plug assembly. Element 18: further including installing an installation ring proximate an upper end of the bottom sub prior to coupling the lateral liner assembly with the bottom sub of the valved wiper plug assembly, the installation ring configured to axially fix the valved housing within the bottom sub. Element 19: further including one or more housing torque lugs coupled to an outside diameter of the valved housing, the one or more housing torque lugs engaged with one or more associated slots formed in an inside diameter of the bottom sub. Element 20: further including drilling out valve member after withdrawing the lateral liner running tool to provide bi-directional fluid flow within the lateral liner assembly. Element 21: wherein drilling out the valve member includes drilling out the valved wiper plug assembly to provide full wellbore access in the lateral wellbore. Element 22: further including drilling out valve member after withdrawing the lateral liner running tool to provide bi-directional fluid flow within the lateral liner assembly. Element 23: wherein drilling out the valve member includes drilling out the valved wiper plug assembly to provide full wellbore access in the lateral wellbore.

Those skilled in the art to which this application relates will appreciate that other and further additions, deletions, substitutions and modifications may be made to the described embodiments.

What is claimed is:

1. A valved wiper plug assembly, comprising:

a valved housing having a unitary body and having a valve member directly coupled thereto; and a wiper plug assembly including a wiper plug housing having a through bore extending therethrough, the wiper plug assembly directly coupled to the valved housing via a shear feature proximate a downhole end of the valved housing, the shear feature configured to shear to allow the wiper plug assembly to decouple and separate from the valved housing and travel downhole, the valve member configured to move between an open state to allow cementing through the through bore and a downhole tip of the wiper plug assembly, and a closed state to catch debris falling from uphole and into the valved housing.

2. The valved wiper plug assembly as recited in claim 1, wherein the valve member is a flapper valve.

3. The valved wiper plug assembly as recited in claim 2, wherein the flapper valve is configured to rotate downhole when moving from the open state to the closed state.

4. The valved wiper plug assembly as recited in claim 1, wherein the valved housing, valve member, and wiper plug assembly are positioned within a bottom sub.

5. The valved wiper plug assembly as recited in claim 4, further including an installation ring engaged proximate an upper end of the bottom sub, the installation ring configured to axially fix the valved housing within the bottom sub.

6. The valved wiper plug assembly as recited in claim 4, further including one or more housing torque lugs coupled to an outside diameter of the valved housing, the one or more housing torque lugs engaged with one or more associated slots formed in an inside diameter of the bottom sub.

7. The valved wiper plug assembly as recited in claim 4, further including a plurality of circumferentially spaced apart housing centralizers coupled to an outside diameter of the valved housing, the plurality of spaced apart housing centralizers engaged with an inside diameter of the bottom sub to centralize the valved housing within the bottom sub.

8. The valved wiper plug assembly as recited in claim 1, wherein the wiper plug assembly includes two or more circumferentially placed wipers, the two or more circumferentially placed wipers configured to wipe an inside diameter of a tubular the wiper plug assembly is configured to traverse.

9. A well system, comprising:

a main wellbore;

a lateral wellbore extending from the main wellbore;

a lateral liner assembly positioned within the lateral wellbore proximate a junction between the main wellbore and the lateral wellbore; and a valved wiper plug assembly coupled with the lateral liner assembly, the valved wiper plug assembly including:

a valved housing having a unitary body and having a valve member directly coupled thereto; and a wiper plug assembly including a wiper plug housing having a through bore extending therethrough, the wiper plug assembly directly coupled to the valved housing via a shear feature proximate a downhole end of the valved housing, the shear feature configured to shear to allow the wiper plug assembly to decouple and separate from the valved housing and travel downhole, the valve member configured to move between an open state to allow cementing through the through bore and a downhole tip of the wiper plug assembly, and a closed state to catch debris falling from uphole and into the valved housing.

10. The well system as recited in claim 9, wherein the valve member is a flapper valve.

11. The well system as recited in claim 10, wherein the flapper valve is configured to rotate downhole when moving from the open state to the closed state.

12. The well system as recited in claim 9, wherein the valved housing, valve member, and wiper plug assembly are positioned within a bottom sub.

13. The well system as recited in claim 12, further including an installation ring engaged proximate an upper end of the bottom sub, the installation ring configured to axially fix the valved housing within the bottom sub.

14. The well system as recited in claim 12, further including one or more housing torque lugs coupled to an outside diameter of the valved housing, the one or more housing torque lugs engaged with one or more associated slots formed in an inside diameter of the bottom sub.

15. The well system as recited in claim 12, further including a plurality of circumferentially spaced apart housing centralizers coupled to an outside diameter of the valved housing, the plurality of spaced apart housing centralizers engaged with an inside diameter of the bottom sub to centralize the valved housing within the bottom sub.

16. The well system as recited in claim 9, further including a lateral liner running tool coupled to the lateral liner assembly.

17. The well system as recited in claim 16, wherein the lateral liner running tool includes a crossover sub having a stinger coupled to a downhole end thereof.

18. The well system as recited in claim 17, wherein the stinger is located within the valved housing propping the valve member in the open state.

19. The well system as recited in claim 18, wherein the stinger includes one or more seals circumferentially placed about an outside diameter thereof, the one or more seals engaged with an inside diameter of the valved housing when the stinger is located therein.

20. A method for cementing a lateral liner assembly, comprising:

positioning a lateral liner assembly within a lateral wellbore proximate a junction between a main wellbore and the lateral wellbore, the lateral liner assembly having a valved wiper plug assembly coupled therewith, the valved wiper plug assembly including:

a valved housing having a unitary body and having a valve member directly coupled thereto; and a wiper plug assembly including a wiper plug housing having a through bore extending therethrough, the wiper plug assembly directly coupled to the valved housing via a shear feature proximate a downhole end of the valved housing, the shear feature configured to shear to allow the wiper plug assembly to decouple and separate from the valved housing and travel downhole, the valve member configured to move between an open state to allow cementing through the through bore and a downhole tip of the wiper plug assembly, and a closed state to catch debris falling from uphole and into the valved housing;

pumping cement through a lateral liner running tool coupled to the lateral liner assembly, through the valved wiper plug assembly, and into an annulus between the lateral liner assembly and the lateral wellbore; and withdrawing the lateral liner running tool to allow the valve member to move from the open state to the closed state.

21. The method as recited in claim 20, further including landing a dart in the valved wiper plug assembly after pumping cement, the dart pushing the cement through the valved wiper plug assembly and out of the wiper plug assembly.

22. The method as recited in claim 21, further including pressuring down on the dart to shear the shear feature, the sheared wiper plug assembly moving downhole to push the cement into the annulus.

23. The method as recited in claim 22, wherein the withdrawing occurs after the pressuring down on the dart.

24. The method as recited in claim 20, further including assembling the valved wiper plug assembly prior to positioning the lateral liner assembly within the lateral wellbore, the assembling including:

positioning the valved housing, valve member, and wiper plug assembly within a bottom sub; and coupling the lateral liner assembly to the bottom sub of the valved wiper plug assembly.

25. The method as recited in claim 24, further including installing an installation ring proximate an upper end of the bottom sub prior to coupling the lateral liner assembly with the bottom sub of the valved wiper plug assembly, the installation ring configured to axially fix the valved housing within the bottom sub.

26. The method as recited in claim 24, further including one or more housing torque lugs coupled to an outside diameter of the valved housing, the one or more housing torque lugs engaged with one or more associated slots formed in an inside diameter of the bottom sub.

27. The method as recited in claim 26, further including drilling out valve member after withdrawing the lateral liner running tool to provide bi-directional fluid flow within the lateral liner assembly.

28. The method as recited in claim 27, wherein drilling out the valve member includes drilling out the valved wiper plug assembly to provide full wellbore access in the lateral wellbore.

29. The method as recited in claim 20, further including drilling out valve member after withdrawing the lateral liner running tool to provide bi-directional fluid flow within the lateral liner assembly.

30. The method as recited in claim 29, wherein drilling out the valve member includes drilling out the valved wiper plug assembly to provide full wellbore access in the lateral wellbore.

* * * * *